United States Patent [19]

Klein et al.

[11] 4,241,457

[45] Dec. 30, 1980

[54] ENERGY IMPACT DISSOLUTION AND TRAUMA REDUCTION DEVICE

[76] Inventors: John M. Klein, 1754 Grant, Birmingham, Mich. 48009; Robert B. Wilson, 4912 Mansfield, Royal Oak, Mich. 48067

[21] Appl. No.: 900,196

[22] Filed: Apr. 26, 1978

[51] Int. Cl.[3] ..... F41H 1/02

[52] U.S. Cl. ..... 2/2.5; 89/36 A; 428/911

[58] Field of Search ..... 2/2.5; 428/911; 89/36 A, 36 D

[56] References Cited

U.S. PATENT DOCUMENTS

| | | | |
|---|---|---|---|
| 1,758,296 | 5/1930 | Schaumann | 428/911 X |
| 2,723,214 | 11/1955 | Meyer | 2/2.5 X |
| 3,398,406 | 8/1968 | Waterbury | 2/2.5 |
| 3,563,836 | 2/1971 | Dunbar | 428/911 X |
| 3,829,899 | 8/1974 | Davis | 2/2.5 |

FOREIGN PATENT DOCUMENTS

| | | | |
|---|---|---|---|
| 1127759 | 4/1962 | Fed. Rep. of Germany | 89/36 A |
| 586886 | 4/1977 | Switzerland | 89/36 D |

*Primary Examiner*—Louis Rimrodt

*Attorney, Agent, or Firm*—Basile, Weintraub & Hanlon

[57] ABSTRACT

A bullet-proof or similar protective garment incorporates therewithin segmented panels. The panels are employed to resist penetration of a bullet or other projectile. The panels are configured such that they are flexible or hinged under ordinary conditions, but rigid upon projectile impact. The hinging is achieved by the disposition of the segments of the panel in relationship to the adjacent segments.

8 Claims, 7 Drawing Figures

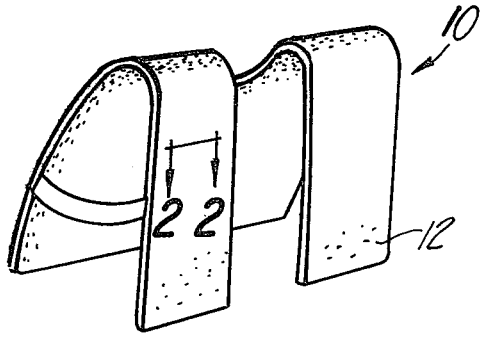
Fig-1
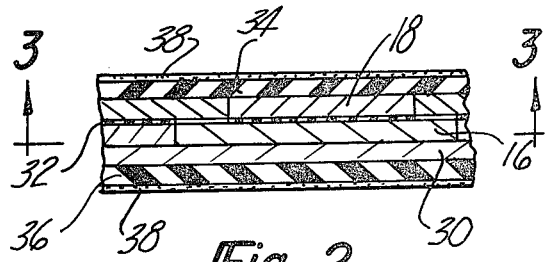
Fig-2
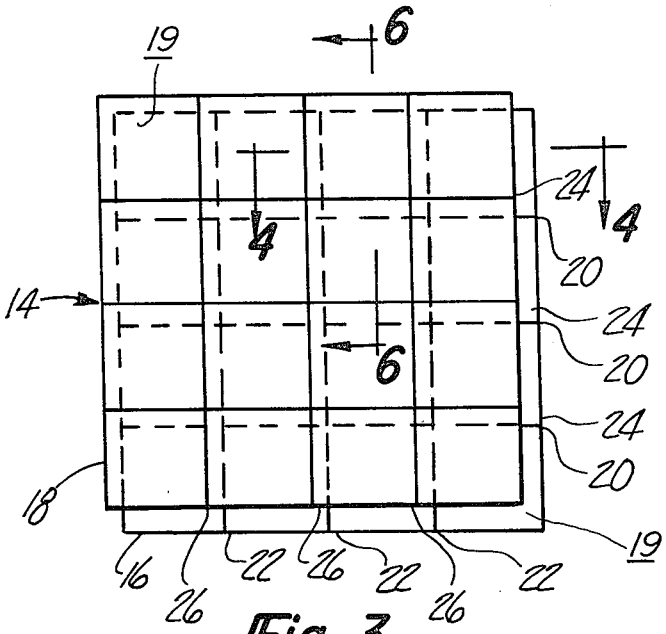
Fig-3
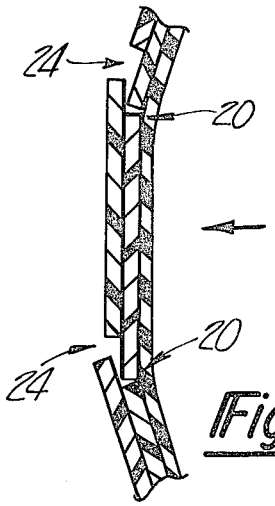
Fig-6
Fig-4
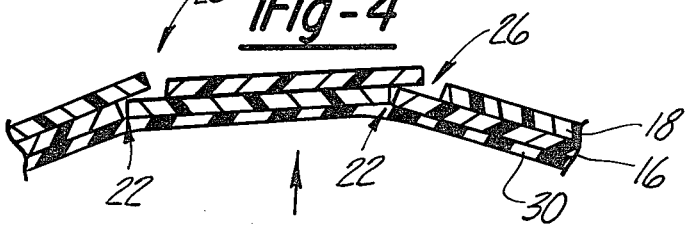
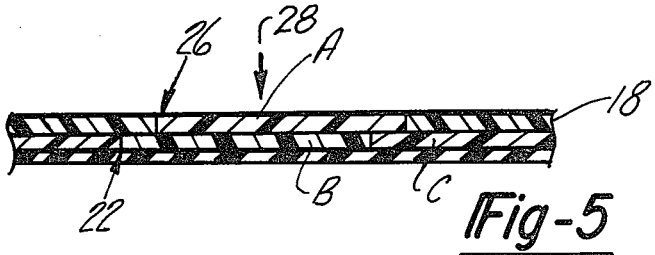
Fig-5
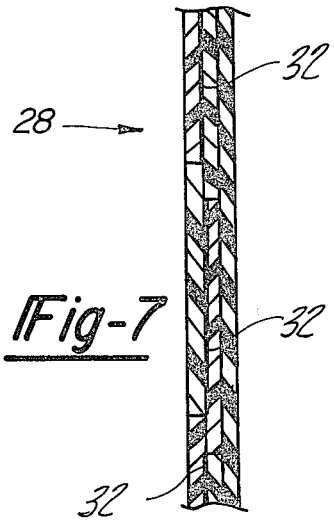
Fig-7

ENERGY IMPACT DISSOLUTION AND TRAUMA REDUCTION DEVICE

BACKGROUND OF THE INVENTION

1. Field of the Invention

The present invention pertains to protective garments. More particularly, the present invention pertains to impact dissipating garments. Even more particularly, the present invention pertains to impact dissipating garments of the type commonly referred to as bullet-proof vests.

2. Prior Art

As is well known to those skilled in the art to which the present invention pertains, the defined purpose of a bullet proof vest is to repel the penetration of a bullet or similar garment into the body of the user. Of course, such types of garments are known.

However, and as known to the skilled artisan, certain problems are occasioned by the provision of presently existing garments of the type under consideration herein. For example, existing garments comprise heavy metal plates for warding off the striking projectile. Such plates greatly reduce the mobility of the garment wearer. Reduction in mobility is occasioned by the weight and bulk of the plate. Furthermore, the plates or other armament repelling media normally comprise one integral or unitary member which is cast or otherwise formed to the shape of a torso. This, greatly reduces the wearer's ability to turn. It is to be appreciated that the problem of mobility is not de minimis.

A still further problem exists with respect to presently known protective garments. This problem is one of dissipating the forces created upon impact of a projectile against the garment. Ordinarily, there is no "shock-absorbing" effect associated with protective garments. Usually, the impact forces, which are intense, are directly transmitted to the wearer. The totality of the effect is of much greater magnitude than any "recoil" effects from shooting a rifle and most often results in severe trauma to the tissue of the wearer's body. The recovery period from this trauma can be quite lengthy and sometimes may not be total.

In the light of the problems outlined above, it is readily perceived that a major advance in the art would be achieved by a protective garment of lighter weight which enhances mobility and which dissipates or absorbs the impact forces of a projectile impacting thereagainst. The present invention, as will subsequently be detailed, achieves these goals and purposes.

SUMMARY OF THE INVENTION

The present invention provides a bullet proof vest of similar protective garment which comprises a projectile repelling system of a pair of overlying and abutting segmented panels. The panels circumscribe the torso of the user and are encased within a cloth fabric like covering.

The segmented panel construction is such that no one segment of any one panel lies completely within the confines of an associated underlying or overlying panel. In other words, the segments of the panels are staggered in relationship to one another. Preferably, the segments of the central portion of one of the panels are in abutting relationship with four segments of the other panel. The adjacent segments of the panels have their contiguous edges joined together by taping or the like to define hinges or seams. These hinges or seams define pivots to permit flexure of the panels.

By virtue of the array or matrix defined by the construction of the panels the incidence of a projectile thereagainst causes the segment upon which incidence is made to impart the thrust to four segments lying thereagainst as well as to the segments of the same panel adjacent thereto. This distribution of forces causes both panels to become rigid since the impact is contra-rotational to the rotational direction permitted by the hinges. Thus, the panels define a rigid impenetrable wall upon projectile impact. Concurrently, the impact forces are distributed throughout all the segments of the panel.

The panels hereof are, preferably, formed from a synthetic resinous material such as a polycarbonate or the like, or from a metal, such as, aluminum steel or the like.

The garment is constructed by stitching a fabric covering over the panel system. Further, protective layers other than the panels can be incorporated into the garment to enhance its properties.

For a more complete understanding of the present invention, reference is made to the following detailed description and accompanying drawing. In the drawing, like reference characters refer to like parts throughout the several views, in which:

BRIEF DESCRIPTION OF THE DRAWING

FIG. 1 is a perspective view of a garment in accordance with the present invention;

FIG. 2 is a cross-sectional view taken along line 2—2 of FIG. 1;

FIG. 3 is a plan view of the panel system hereof taken along line 3—3 of FIG. 2;

FIG. 4 is a cross-sectional view taken along line 4—4 of FIG. 3, but which depicts the panel system in a flexed mode;

FIG. 5 is a view similar to FIG. 4, but showing the panel system in a rigid state;

FIG. 6 is a cross-sectional view taken along line 6—6 of FIG. 3, but which depicts the panel system in a flexed mode, and FIG. 7 is a view similar to FIG. 6 but which shows the panel system in a rigid state.

DESCRIPTION OF THE PREFERRED EMBODIMENT

Now, and with reference to the drawing, there is depicted therein a protective garment, generally, denoted at 10. The protective garment depicted in the drawing is a "bullet-proof" vest 12. For purposes of facilitating an understanding of the present invention the ensuing description shall be provided in the context of a vest. However, it is to be understood that the invention is applicable to all types of garments which are designed to dissipate impact forces and reduce the attendant trauma.

The vest 12 hereof comprises a panel system 14 in accordance with the present invention. The panel system 14 comprises a pair of superposed panels 16, 18. Each panel is segmented into a plurality of segments 20. The segments 20 are similar to one another and equally dimensioned.

For purposed of facilitating an understanding hereof, the panels 16 and 18 will be referred to, respectively, as lower and upper panels. Particularly, referring to FIGS. 3-7, it will be perceived that the segments of the panels are disposed in relationship to one another in a pre-determined array. Specifically, no one panel segment of panel 18 completely overlies any one associated panel segment of panel 16. In other words, there is no total coincidence between any one panel segment of panel 18 and any one panel segment of panel 16. Rather, and in accordance herewith, the medial or central panel segments abut and are contiguous with four segments of the other panel with a substantial portion of any one panel segment of one panel being coincident with only one segment of the other panel, as shown.

As clearly shown in FIG. 3, the panel segments of panel 16 are aligned and disposed such that adjacent panels have their contiguous edges in abutting relationship to define a plurality of horizontal and vertical seams 20 and 22, respectively. The panel segments of panel 18 are similarly aligned to define seams 24 and 26. It is to be appreciated that by the shifting of the panel segments of panel 18 out of total coincidence with the associated segment of panel 18 that no one seam 20 or 22 aligns with an associated seam 24 or 26. This is of utmost criticality to the present invention. As will be readily seen in FIGS. 4 and 6, the seams 20 and 22 function as hinges which permit flexing of the associated abutting panel segments. The flexing of the panel segments about the seam 20 or 22 causes a similar motion to be imparted to each of the panel segments of panel 18 which encroach or traverse the seam. Thus, the rotation at flexing the panel segments of panel 16 causes a similar flexing of the panel segments of panel 18. Furthermore, because of the segmentation of the panels, flexing is readily achieved.

Referring to FIGS. 5 and 7, there is depicted the effect of an impact caused by a bullet or other projectile encountering the panel system hereof. Assuming a projectile following the path of travel of an arrow 28, the projectile will impact againt panel segment A of panel 18. This impact will be imparted to each of the four panel segments of panel 16 with which panel A is coincident. Because of the seaming, this impact causes each of the panel segments of panel 16 to become rigid or abutted. Furthermore, because of the disposition of the panel segments of panel 18, as the panel segments of panel 16 are forced into abutment, likewise are the panel segments of panel 18. Thus, the effect of the impact along arrow 28 is to render each panel 16 and 18 rigid. It is to be appreciated that this could not be achieved if each panel segment of panel 16 was coincident with or superposed with one and only one panel segment of panel 18. The array hereof is critical because the impacting on any one central panel segment of panel 18 is transmitted to four segments of panel 16 which, in turn, reacts on eight more segments of panel 18, and so forth. If there is total segment to segment coincidence the only transmittal of impact forces is from the upper to the lower panel segment only. By virtue of the present array, the impact energy is transmitted throughout the panel system and is, thusly, dissipated. This tremendously reduces the impact transmitted to the wearer which would otherwise occur.

Referring, again, to the drawing and in accordance herewith, the lower panel 16 has the seams 20, 22 thereof taped to maintain interconnection between the segments defining the panel. The tape 30 comprises any commercially available high tensile strength bi-directional fibrous tape.

As heretofore noted and as shown in the drawing, each segment of panel 18 has a substantial portion of its surface area overlying one main associated segment of panel 16. It is the peripheral edges and area of the segment of panel 18 that overlies the segments adjacent to the main associated segment of panel 16. The interface or common area of the segment of panel 18 and the main associated segment of panel 16 is maintained by applying an adhesive 32 thereto. The adhesive 32 insures that no disruption of the interfaces occurs. The adhesives utilized herein are extremely strong commercially available adhesives such as epoxy, silicone adhesives, cyanoacrylate adhesives and the like. The silicones have, to date, been the most efficacious. It is to be noted that it is only the interfaces that have the adhesives applied thereto.

In constructing a protective garment in accordance herewith an elastomeric covering 34 such as rubber is secured to the front or exterior surface of panel 18. A heavy filament fiber fabric 36 is associated with, secured or adhered to the area or exterior surface of panel 16. These heavy fibers are well known and commercially available. A preferred fabric is that sold by Dupont under the name KEVLAR.

Lastly, a fabric such as a heavy khaki broadcloth 38 is used to enclose and cover the interior of the garment. It should be noted with respect hereto that the rubber covering maintains the segments of panel 18 in position, the rubber covering being adhered to the panel. The filament fiber prevents penetration of the projectile into the body of the user by halting or otherwise stopping it if it gets past the panel system. Also, the fiber enables trapping of any pieces of the projectile or panel which may precede the projectile in those instances where impacting causes a rupture of a panel segment as well as of the projectile.

The panel system, per se, can be formed from a variety of materials, including synthetic resinous materials, as well as various metals. Thus, the panel segments can be formed from steel or other high impact resistant metals. High impact plastics such as polycarbonates can, also, be used. In this regard, it is to be noted that the polycarbonates of bisphenol A sold under the name LEXAN have demonstrated their efficacy in the practice of the present invention. It is possible in accordance herewith to have an all metal panel system and all plastic panel system or a mixed plastic and metal system where one panel is plastic and one metal or some segments metal and some plastic. All such combinations are within the scope of the present invention.

It is to be appreciated from the preceding that there has been described herein a protective garment which enhances the mobility of the wearer while increasing energy dissipation to reduce the trauma associated with projectile impact.

Having, thus, described the invention what is claimed is:

1. An energy dissipation system for use in protective garments comprising:

(a) a first panel comprising a plurality of segments, each segment being in abutting relationship with adjacent segments, each abutment defining a seam, (b) means interconnecting the segments of the panel along the seams, which means cooperate with said seams to permit the segments to limitedly rotate about the seams, (c) a second panel overlying the first panel, the second panel comprising a plurality of segments, each one segment of the second panel being associated with one segment of the first panel such that a substantial portion of the first panel such that a substantial portion of the second panel segment overlies a substantial portion of the first panel segment associated therewith to define an interface therebetween, the peripheral portion of the second panel segment overlying the panel segments adjacent the one first panel segment, and (d) means for adhering the associated panel segments at the interface thereof.

2. The energy dissipation system of claim 1 wherein: the interconnecting means is a high tensile strength fibrous tape.

3. The energy dissipation system of claim 1 wherein: the means for adhering comprises an adhesive.

4. The energy dissipation system of claim 1 wherein the panel segments are formed from either a metal or a synthetic resinous material.

5. A protective garment, comprising:

(a) a first panel comprising a plurality of segments, each segment being in abutting relationship with adjacent segments, each abutment defining a seam, (b) means interconnecting the segments of the panel along the seams, which means cooperate with said seams to permit the segments to limitedly rotate about the seams, (c) a second panel overlying the first panel, the second panel comprising a plurality of segments, each one segment of the second panel being associated with one segment of the first panel such that a substantial portion of the second panel segment overlies a substantial portion of the first panel segment associated therewith to define an interface therebetween, the peripheral portion of the second panel segment overlying the panel segments adjacent the one first segments, and (d) means for adhering the associated panel segments at the interface thereof.

6. The garment of claim 5 which further comprises: an elastomeric covering adhered to the exterior of the second panel.

7. The garment of claim 5 which further comprises: a filament fabric secured to the exterior of the first panel, the fabric overlying the means for interconnecting the segments.

8. The garment of claim 5 which further comprises:

(a) an elastomeric covering adhered to the exterior of the second panel.

(b) a filament fabric secured to the exterior of the first panel and overlying the means for interconnecting the segments, and (c) an outer covering fabric which covers the filament fabric and the elastomeric covering.

* * * * *

UNITED STATES PATENT AND TRADEMARK OFFICE

CERTIFICATE OF CORRECTION

PATENT NO. 4,241,457

DATED December 30, 1980

INVENTOR(S) John M. Klein. et al

It is certified that error appears in the above-identified patent and that said Letters Patent are hereby corrected as shown below:

Column 1, line 54, following "vest" delete "of" and insert --or--;

Column 1, line 58, following "fabric" insert --or--;

Column 2, line 16, following "aluminum" insert -- , --;

Column 2, line 61, following "segments" delete "20" and insert --19--;

Column 2, line 62, following "segments" delete "20" and insert --19--;

Column 3, line 63, following "30" insert --which cooperates with the seams defined by the abutment of the segment, to permit the segments to limitedly rotate about the seams,--;

Column 4, line 67, and line 68, following "panel" delete "such that a substantial portion of the first panel".

Signed and Sealed this

*Fourteenth* Day of *April 1981*

[SEAL]

*Attest:*

RENE D. TEGTMEYER

*Attesting Officer*

*Acting Commissioner of Patents and Trademarks*